US008385803B2

(12) United States Patent
Nanno

(10) Patent No.: US 8,385,803 B2
(45) Date of Patent: Feb. 26, 2013

(54) BELT-TYPE FIXING DEVICE AND IMAGE FORMING APPARATUS CAPABLE OF MAINTAINING PRESCRIBED TENSION OF BELT

(75) Inventor: Shigeo Nanno, Kyoto (JP)

(73) Assignee: Ricoh Company Limited, Tokyo (JP)

( * ) Notice: Subject to any disclaimer, the term of this patent is extended or adjusted under 35 U.S.C. 154(b) by 292 days.

(21) Appl. No.: 12/805,009

(22) Filed: Jul. 7, 2010

(65) Prior Publication Data

US 2011/0008082 A1 Jan. 13, 2011

(30) Foreign Application Priority Data

Jul. 8, 2009 (JP) ..... 2009-161464

(51) Int. Cl.
*G03G 15/20* (2006.01)

(52) U.S. Cl. ..... 399/329; 399/122

(58) Field of Classification Search ..... 399/107, 399/110, 122, 320, 328, 329; 219/216, 619
See application file for complete search history.

(56) References Cited

U.S. PATENT DOCUMENTS 6,763,218 B2 * 7/2004 Hamada et al. ..... 399/329
7,603,069 B2 * 10/2009 Yamana et al. ..... 399/328
7,693,435 B2 * 4/2010 Moriguchi et al. ..... 399/33

FOREIGN PATENT DOCUMENTS

JP 2002-268436 9/2002
JP 2005-128337 5/2005
JP 3986264 7/2007

OTHER PUBLICATIONS

Abstract of Japanese Patent Publication No. 2002-251095, published on Sep. 6, 2002.

* cited by examiner

*Primary Examiner* — Hoan Tran
(74) *Attorney, Agent, or Firm* — Harness, Dickey & Pierce, P.L.C.

(57) ABSTRACT

A fixing device includes a fixing roller that fixes a non-fixed toner image onto a sheet, a separation roller arranged downstream of the fixing roller to separate the sheet, and an endless fixing belt wound around the fixing roller and the separation roller. A pressing roller presses against the fixing roller via the fixing belt and cooperatively fixes the non-fixed toner image with the fixing roller. A guiding member is secured to the fixing device and has a guiding hole. The guiding member guides the separation roller when the separation roller approaches or withdraws from the fixing roller along the guiding hole. A belt tensioner creates a prescribed tension on the fixing belt by applying tension use biasing force to the separation roller in an opposite direction to the fixing roller. A driving force transmitting device directly transmits rotational driving force to the separation roller via an engaging section of the separation roller. The guiding hole has an arc shape coaxially formed with the driving force transmitting device.

12 Claims, 10 Drawing Sheets

FIG. 16 (Conventional)
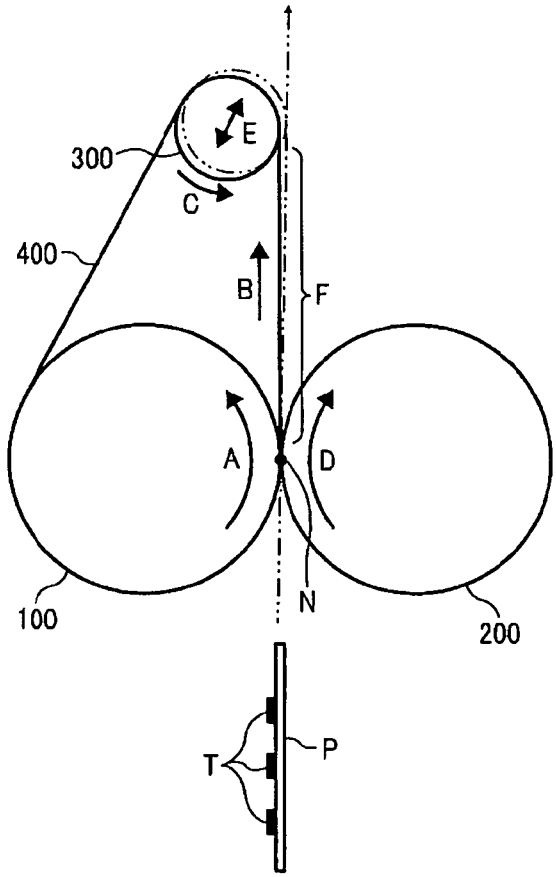

FIG. 17 (Conventional)
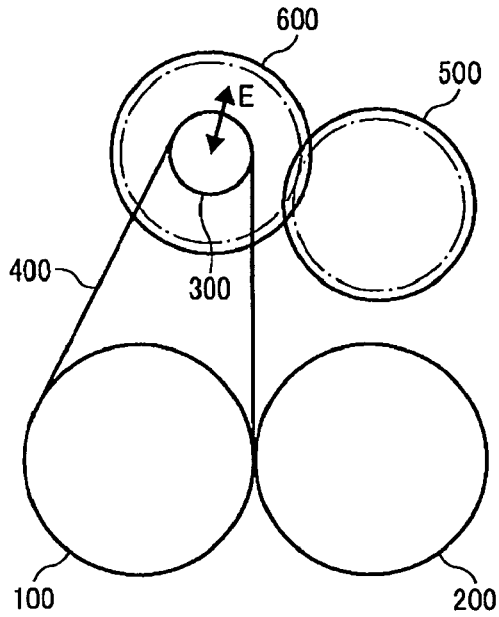
FIG. 18 (Conventional)
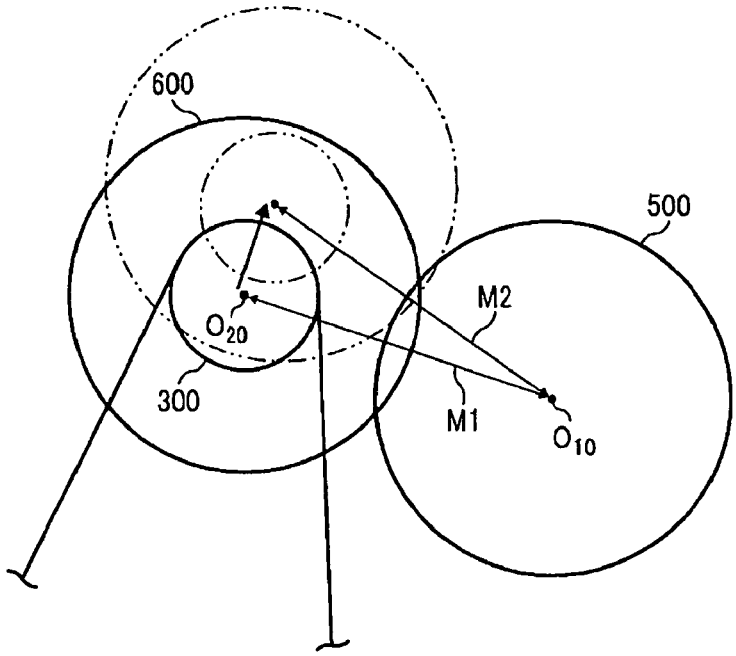

BELT-TYPE FIXING DEVICE AND IMAGE FORMING APPARATUS CAPABLE OF MAINTAINING PRESCRIBED TENSION OF BELT

CROSS-REFERENCE TO RELATED APPLICATIONS

This application claims priority under 35 USC §119 to Japanese Patent Application No. 2009-161464, filed on Jul. 8, 2009, the entire contents of which are hereby incorporated by reference.

BACKGROUND OF THE INVENTION

1. Field of the Invention

The present invention relates to a fixing device for fixing an image onto a printing medium by applying heat and pressure thereto, and an image forming apparatus, such as a copier, a printer, a facsimile, a multi-functional machine, etc., having the fixing device.

2. Discussion of the Background Art

An image forming apparatus usually employs a fixing device that fixes a toner image on a printing medium by applying heat and pressure thereto. The fixing device generally includes a fixing roller heated by a heat source and a pressing roller pressing against the fixing roller. Specifically, the toner image is fixed onto the printing medium when the printing medium with the toner image is conveyed through a fixing nip created between the fixing roller and the pressing roller.

However, due to melting and adherence of the toner to the fixing roller during such a fixing process, especially when a print rate is high, it can happen that the printing medium winds around the fixing roller and offset of a toner image appears, for example.

Then, many fixing devices have been proposed to improve a separation performance of separating the printing medium from the fixing roller. For example, as shown in FIG. 16, a conventional fixing device includes a fixing roller 100, a pressing roller 200, a separation roller 300, and an endless fixing belt 400 wound around the separation and fixing rollers. The pressing roller 200 presses against the fixing belt 400 while opposing the fixing roller 100 and creating a fixing nip N there. Further, the fixing roller 100 receives a driving force from a driving source, not shown, and rotates in an arrow A showing direction. Thus, as the fixing roller 100 rotates, the fixing belt 400 travels in an arrow B showing direction, and the separation roller 300 and the pressing roller 200 are driven and rotated in arrow C and D showing directions, respectively.

When a sheet P with a transferred toner image T enters the fixing nip N, the toner image T is heated, pressed, and fixed thereonto. Then, the sheet P is conveyed by the fixing belt 400 and is separated by the separation roller 300. Thus, the fixing device cools down the toner on the sheet P during conveyance on the fixing belt to facilitate separation of the sheet P therefrom.

The fixing belt sometimes expands when heated. Thus, not to slack even causing the thermal expansion, the fixing belt 400 needs a prescribed tension. In such a situation, a tension roller can be employed beside the fixing roller 100 and the separation roller 300 to create the prescribed tension on the fixing belt 400. However, number of parts increases and the apparatus becomes bulky. To avoid such a problem, the separation roller 300 can be made to function as the tension roller.

Specifically, the separation roller 300 may be moved to either approach or withdraw from the fixing roller 100 in the arrow E showing direction by biasing the separation roller 300 toward the fixing roller 100 using a spring, not shown, and applying tension to the fixing belt 400.

However, since the fixing roller 100 rotates while the separation roller 300 is driven and rotated, the fixing belt 400 tends to slacken at a position F in which the sheet P is conveyed from the fixing nip N to the separation roller 300. When the fixing belt 400 slackens, the sheet after the fixing process cannot tightly contact the same, and accordingly, an offset image or unevenness of gloss appears.

Another conventional fixing device provides a separation roller 300 with a driving force to rotate the fixing roller 100. Thus, the fixing belt 400 is stretched as it travels suppressing slack in the path F, so that image offset or gloss unevenness can be suppressed.

As mentioned above, to effectively obtain a fine image without slack in the fixing belt, the separation roller preferably serves both as a tension roller and a driving roller.

Further, a fixing device having a separation roller 300 sometimes serves both as the tension and driving rollers as illustrated in FIG. 17. Specifically, a driving gear 600 is integrally attached to the separation roller 300, and is meshed with a power transmission gear. Thus, a driving force from a motor, not shown, is transmitted to the driving gear 600 via the power transmission gear 500 to rotate the separation roller 300. Further, the separation roller 300 is arranged to either approach or withdraw from the fixing roller 100 in the arrow E showing direction. The separation roller 300 is biased by a spring, not shown, and withdraw from the fixing roller 300 so that the fixing belt 400 has a prescribed tension.

Thus, as shown in FIG. 18, when the separation roller 300 moves along a straight line from the position shown by a solid line to that shown by a broken line, a relative distance between the rotational center $O_{20}$ of the separation roller 300 and that of $O_{10}$ of the power transmission gear 500 changes from M1 to M2. Consequently, a condition of meshing of the driving gear 600 with the power transmission gear 500 becomes uneven, rotational force is not stably transmitted to the separation roller 300, and unevenness of rotation occurs. As a result, image quality deteriorates and the life of the gear is shortened.

SUMMARY OF THE INVENTION

Accordingly, an object of the present invention is to improve such background arts technologies and provides a new and novel fixing device. Such a new and novel fixing device includes a fixing roller that fixes a non-fixed toner image onto a sheet, a separation roller arranged downstream of the fixing roller to separate the sheet, and an endless fixing belt wound around the fixing roller and the separation roller. A pressing roller presses against the fixing roller via the fixing belt and cooperatively fixes the non-fixed toner image with the fixing roller. A guiding member is secured to the fixing device and has a guiding hole. The guiding member guides the separation roller when the separation roller approaches or withdraw from the fixing roller along the guiding hole. A belt tensioner creates a prescribed tension on the fixing belt by applying tension use biasing force to the separation roller in an opposite direction to the fixing roller. A driving force transmitting device directly transmits rotational driving force to the separation roller via an engaging section of the separation roller. The guiding hole has an arc shape coaxially formed with the driving force transmitting device.

In another aspect of the present invention, a biasing force applied to the engaging section from the driving force transmitting device is directed to a prescribed direction so that the separation roller withdraw from the fixing roller.

In yet another aspect of the present invention, a bearing is attached to a rotary shaft of the separation roller, a driving gear is integrally mounted on the rotary shaft, and a power transmission gear is integrally mounted on a rotary shaft of the driving force transmitting device. The power transmission gear meshes with the driving gear, and the guide member guides the bearing.

In yet another aspect of the present invention, the power transmission gear is arranged on the pressing roller side of a straight line extending through rotational centers of the fixing roller and the separation roller.

In yet another aspect of the present invention, a driving gear is integrally mounted on the separation roller, and a gear train is included in the driving force transmitting device. The gear train has plural power transmission gears linked with each other and engages with the driving gear at its one end. A supporting member integrally supports the gear train, the driving gear, and the separation roller. The supporting member swings around a rotational center of one of the plural power transmission gears arranged on the other end of the gear train.

In yet another aspect of the present invention, the gear train is arranged on the pressing roller side of a straight line extending through rotational centers of the fixing roller and the separation roller when there is an odd number of power transmission gears, and on the opposite side of the straight line to the pressing roller when there is an even number of power transmission gears.

In yet another aspect of the present invention, a driving use pulley is integrally mounted on the separation roller, a power transmission use pulley is mounted on the driving force transmitting device, and a power transmission use endless belt is wound around the driving use pulley and the power transmission use pulley. A supporting member is provided to integrally support the power transmission use pulley, the driving use pulley, and the separation roller. The supporting member swings around a rotational center of the power transmission use pulley.

In yet another aspect of the present invention, the power transmission use pulley is arranged on the opposite side of a straight line extending through rotational centers of the fixing roller and the separation roller to the pressing roller.

In yet another aspect of the present invention, the tension application device includes a pair of tension application devices attached to both ends of the separation roller, respectively. The driving force transmitting device transmits the rotational drive force to one end of the separation roller and generates a prescribed biasing force at the engagement section, with the prescribed biasing force being directed opposite to the fixing roller to cause the separation roller to be distanced from the fixing roller. A component of the tension use biasing force applied to one end of the separation roller is smaller than that applied to the other end during the movement of the separation roller along the guiding member, and, is parallel to a tangent line of the arc shape. The one end receives the rotational driving force from the driving force transmitting device.

In yet another aspect of the present invention, the pair of tension application devices includes the same type of elastic members, and the component of the one end is made smaller than that of the other end by differentiating an elastic deformation amount from the other.

In yet another aspect of the present invention, the pair of tension application devices includes the same type of elastic members, and the component of the one end is made smaller than that of the other end by differentiating a direction of biasing force of the tension application device from the other.

In yet another aspect of the present invention, an image forming apparatus includes the fixing device described above.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 16 illustrates a conventional fixing device;

FIG. 17 illustrates an exemplary fixing device including a separation roller that serves both as a driving roller and a tension roller; and FIG. 18 illustrates an exemplary change of a relative distance between the power transmission gear and the separation roller.

PREFERRED EMBODIMENTS OF THE PRESENT INVENTION

Figure 1:
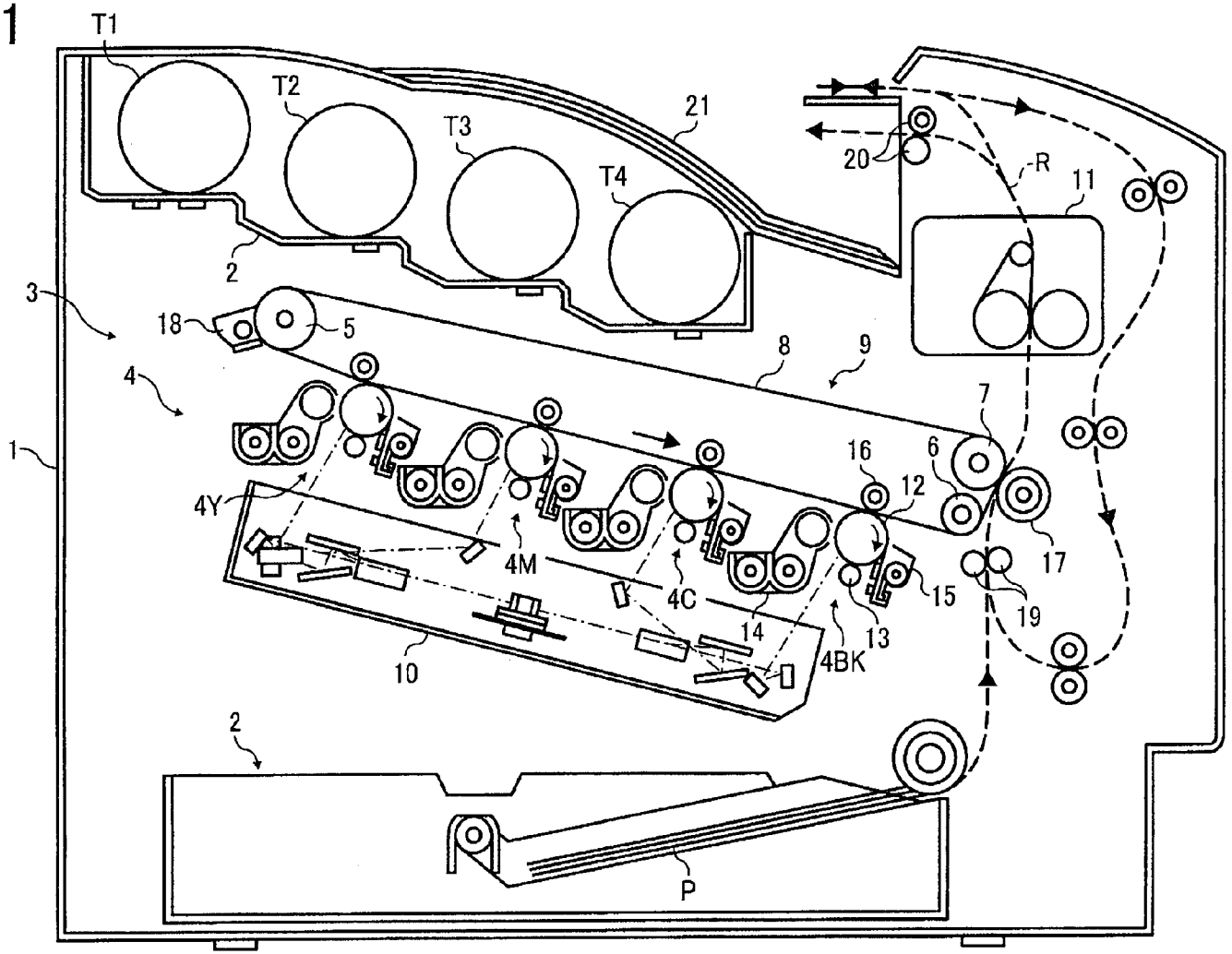
FIG. 1 illustrates an exemplary color image forming apparatus according to one embodiment of the present invention.

Referring now to the drawing, wherein like reference numerals designate identical or corresponding parts throughout several views, in particular in FIG. 1, an, exemplary color image forming apparatus according to one embodiment is described. As show, the color image forming apparatus is tandem type including one of a copier, a printer, a facsimile, and a multi functional machine or the like. Beside, the tandem color image forming apparatus, a monochrome image forming apparatus can be employed.

Initially, a fundamental configuration and an operation of the printer of the one embodiment is described. The image forming apparatus 1 as the printer includes a sheet-feeding cassette 2 in its lower section, which accommodates sheets P as printing mediums. The image forming apparatus 1 also includes an image forming section 3 above the sheet-feeding cassette 2. The image forming section 3 includes an imaging section 4 that includes four image formation units 4Y, 4C, 4M, and 4BK having image bearers, respectively, an intermediate transfer unit 9 that includes an intermediate transfer belt 8 wound around plural rollers 5 to 7, an optical writing unit 10 that optically writes images on the respective image bearers, and a fixing device 11 that fixes a toner image onto a sheet P. The image formation units 4Y to 4BK and the intermediate transfer unit 9 are detachable from the apparatus body 1. A conveyance path R is formed in the apparatus 1 to convey the sheet P as shown by a dotted line.

The respective image formation units 4Y to 4BK include photoconductive drums 12 contacting the intermediate transfer belt 8. Around each of the photoconductive drums 12, there are provided a charge device 13, a developing device 4, and a cleaning device 15. Inside a loop of the intermediate transfer belt 8, plural primary transfer rollers 16 are arranged opposing the respective photoconductive drums 12 to execute a primary transfer process.

Since these image formation units 4Y to 4BK have substantially the same structure, only that of 4BK is typically described herein below. Only difference between the respective image formation units 4Y to 4BK is color of toner stored in the respective developing devices 14. Specifically, yellow, cyan, magenta, and black toner are stored. When the toner decreases, fresh toner is replenished from toner replenishment bottles T1 to T4 arranged in the upper section of the apparatus body 1 to the developing devices 14, respectively.

The optical writing unit 10 is arranged in the lower section as shown in FIG. 1, and emits an optically modulated laser light to surfaces of the respective photoconductive drums 12 to form latent images of four mono colors. Further, the toner replenishment bottles T1 to T4, the intermediate transfer unit 9, the image formation units 4Y to 4BK, and the optical writing unit 10 are inclined in the same direction. Thus, an installation area of the apparatus body 1 is smaller than that when those devices are arranged horizontally.

Further, opposing to the roller 7 via the intermediate transfer belt 8, there is provided a secondary transfer roller 17 to execute a secondary transfer process. Also arranged on the outer surface of the intermediate transfer belt 8 is a belt-cleaning device 18 to execute cleaning of the surface of the intermediate transfer belt 8.

When image formation starts, a driving device, not shown, drives and rotates the respective photoconductive drums 12 of the image formation units 4Y to 4BK, and these surfaces are uniformly charged in prescribed polarity. Then, respective surfaces are subjected to emission of laser light beams from the optical writing unit 10, and whereby form latent images thereon. At that time, image information included in the laser light exposed to the respective photoconductive drums 12 include monochrome component colors of yellow to black, which are resolved from a prescribed full-color image. Then latent images are visualized when passing through the gaps between the photoconductive drums 12 and the developing devices 14.

One of the plural rollers 5 to 7 winding the intermediate transfer belt 8 is driven counter clockwise by a driving device, not shown. Thus, the intermediate transfer belt 8 travels counter clockwise as shown by an arrow, and the remaining rollers are thereby driven rotated. Further, a prescribed voltage subjected to voltage or current constant control having an opposite polarity to that of a charge of toner is applied to each of the respective primary transfer rollers 16. Thus, respective transfer electric fields are formed between the printing medium transfer rollers 16 and the photoconductive drums 12. Then, respective component color toner images formed on the respective photoconductive drums 12 of the image formation units 4Y to 4BK are transferred at the primary transfer nips onto the intermediate transfer belt 8 and superimposed, sequentially. Thus, a full-color image is carried on the surface of the intermediate transfer belt 8.

Toner remaining on the surfaces of the respective photoconductive drums 12 after the transfer processes of the toner images are removed therefrom by the cleaning devices 15. Then, the surfaces are subjected to charge removing processes of charge removing devices, not shown, and respective surface potentials are initialized to prepare for the next image formation.

The sheet P is fed from the sheet feeding section 2, and is launched into a conveyance path R toward a registration roller pair 19 arranged on the sheet feeding side than the secondary transfer roller 17. The registration roller pair 19 times and feeds the sheet P at a prescribed time toward the gap between the secondary transfer roller 17 and an opposing roller 7. At that moment, a transfer voltage having an opposite polarity to that of charge of the toner image on the intermediate transfer belt 8 is applied to the secondary transfer roller 17. Thus, the toner images are transferred at once from the intermediate transfer belt 8 onto the sheet P. The sheet P carrying the toner image thus transferred is conveyed to the fixing device 11, so that the toner image is fused by heat and pressure when passing through the fixing device 11. Then sheet P is then ejected by an ejection roller pair 20 arranged at the end of the conveyance path onto a stock section 21 arranged on the upper part of the apparatus body. Toner remaining on the intermediate transfer belt 8 after the transfer process is removed by a belt cleaning device 18.

Instead of the above-mentioned full-color image formation, a mono color or dual or triple color images can be formed selectively using applicable one to three of the image formation units of the image formation section 4. Specifically, when monochrome printing is executed with the above-mentioned printer, only the image formation unit 4BK is used.

Now, an exemplary unique fixing device according to one embodiment of the present invention is described with reference to FIG. 2.

As shown, a first exemplary fixing device 11 includes a fixing roller 21 having a heat source 25, a separation roller 22, an endless fixing belt 23 wound around both of the fixing roller 21 and the separation roller 22, and a pressing roller 24 pressure contacting the fixing roller 21 via the fixing belt 23.

The fixing roller 21 includes a pipe made of metal, such as aluminum, iron, etc., having an outer diameter of from 20 to 35 mm. The heat source 25 includes a halogen heater or the like to generate heat. The fixing roller 21 can be covered with an elastic layer made of silicon rubber having a thickness not more than 1 mm.

The separation roller 22 has a smaller diameter than the fixing roller 21, such as from 6 mm to 15 mm, etc., and is made of metal, such as aluminum, iron, etc. The separation roller 22 is enabled to approach and distance from the fixing roller 21. Specifically, a pair of support plates 27 are arranged at both widthwise ends of the fixing roller 21, respectively. Each of the pair of supporting plates 27 includes an oblong guide section 28, into which a bearing 26 that supports an end of the separation roller 22 is inserted. As the bearing 26 moves along the guide section 28, the separation roller 22 either approaches or distances from the fixing roller 21.

A biasing member, not shown, is provided to bias the both ends of the separation roller 22 to distance from the fixing roller 21 in a direction as shown by an arrow G. A biasing force of the biasing member is from about 2 to about 20 kgf. Thus, a prescribed tension is given to the fixing belt 23. Specifically, the separation roller 22 serves as a tension roller.

When the outer diameter of the separation roller 22 is relatively small, such as about 6 mm, etc., the separation roller 22 likely bends, and accordingly, the fixing belt unevenly either travels, shifts to one side, or has wrinkle or the like due to a biasing force applied to the both ends. Thus, in such a situation, the separation roller 22 is preferably a solid metal type. To the contrary, when the outer diameter of the separation roller 22 is relatively large, such as not less than about 15 mm, etc., the separation roller 22 is preferably a hollow metal type to minimize calorie and improves heating efficiency as far as possible. Further, the above-mentioned bending and shifting or wrinkle of the fixing belt 23 can be suppressed by slightly increasing the outer diameter at each of the widthwise ends than a center of the separation roller 22.

The pressing roller 24 includes a core metal, an elastic layer overlying the metal core, and a releasing layer overlying the elastic layer. The metal core includes a metal roller made of aluminum or iron or the like. Then elastic layer is made of liquid state silicon or foam silicon, or the like. The thickness of the elastic layer is preferably from 2 mm to 6 mm. The releasing layer is made of PFA and PTF or the like.

The pressing roller 24 is enabled to approach or distance from the fixing roller 21. Specifically, a biasing member, not shown, is provided to bias the pressing roller 24 to approach the fixing roller. A biasing force of the biasing member is from about 40 to 80 kgf. By biasing this way, the pressing roller 24 pressure contacts the fixing roller 21 via the fixing belt 23 by a prescribed pressure. Thus, a fixing nip N is created at a section where the pressing roller 24 contacts the fixing belt 23.

The fixing belt 23 includes a substrate, an elastic layer overlying the substrate, and a releasing layer overlying the elastic layer. The substrate is made of resin, such as polyimide, etc. The thickness of the substrate is preferably from 50 to 150 micrometer. Then elastic layer is made of silicon rubber or the like. The thickness of the elastic layer is preferably from 100 to 200 micrometer. The releasing layer is made of PFA, FEP, PTFE, or the like. The thickness of the releasing layer is preferably from 20 to 50 micrometer. To decrease heat capacity, the fixing belt 23 can only include substrate made of resin or metal, such as stainless, etc.

The fixing device 11 includes a driving force transmission gear 30 as a driving force transmitting device for directly transmitting rotational force from a driving source, not shown, to the separation roller 22. Further, a driving gear 31 is integrally arranged with the separation roller 22 meshing with the driving force transmission gear 30. Thus, the driving force is transmitted from the driving source to the driving gear 31 via the driving force transmission gear 30, so that the driving gear 31 and the separation roller 22 can integrally rotate. Further, the fixing belt 23, the fixing roller 21, and the pressing roller 24 are driven rotated by the separation roller 22. Thus, the separation roller 22 serves a driving roller.

Further, the guide section 28 has a circular arc regarding a rotational center O1 of the power transmission gear 30. Thus, a moving route X of the separation roller 22 moving along the guide section 28 has the same circular arc.

As shown, the power transmission gear 30 is arranged on the side of the pressing roller 24 (i.e., on the right side in the drawing) of a straight line L extending through a rotational center $O_3$ of the fixing roller 21 and that of $O_2$ of the separation roller 22. When the power transmission gear 30 is rotated in the arrow showing direction in the drawing, biasing force H1 is upwardly applied to the driving gear 31 at an engaging section where the power transmission gear 30 engages with the driving gear 31. Specifically, the biasing force H1 functions to distance the separation roller 22 away from the fixing roller 21.

Figure 2:
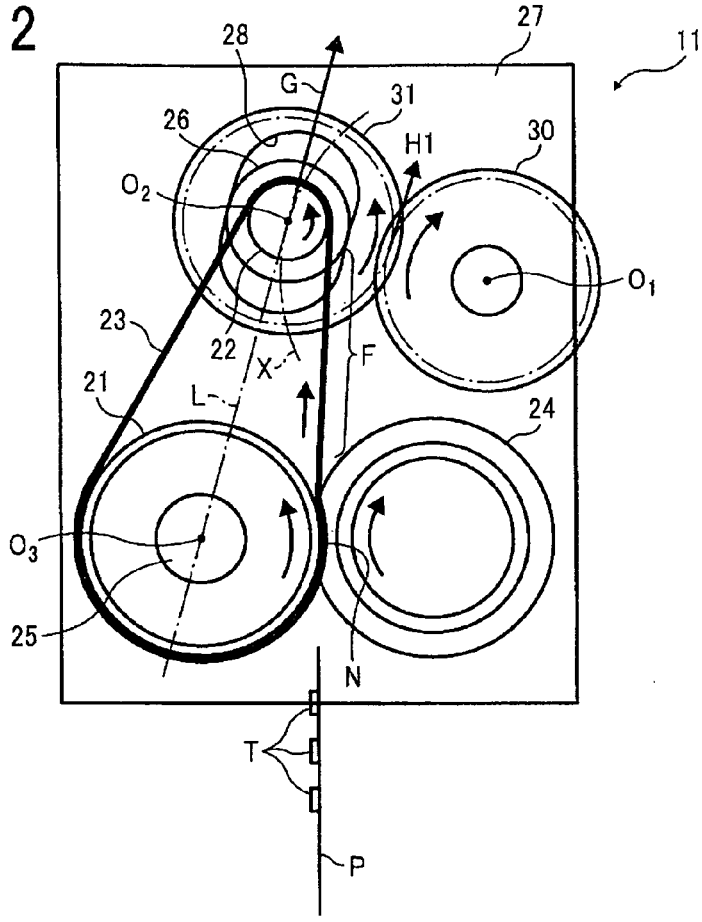
FIG. 2 illustrates an exemplary fixing device of the first embodiment.
Figure 3:
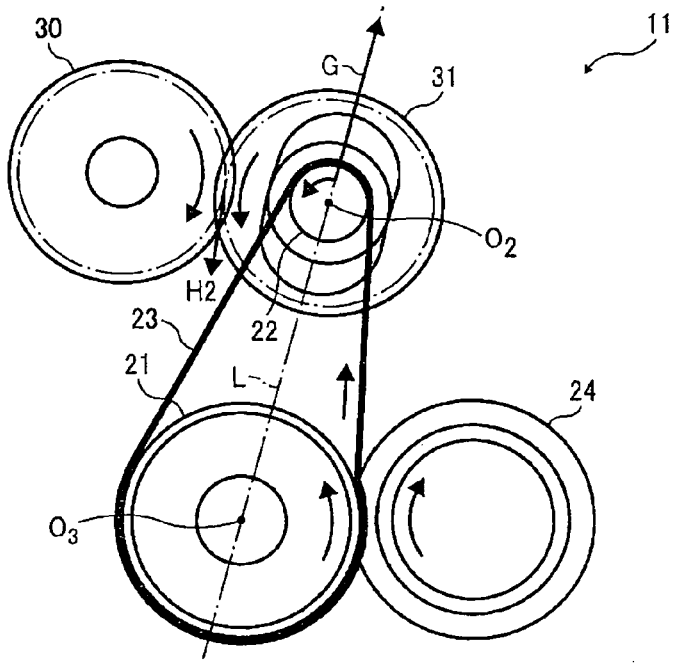
FIG. 3 illustrates an exemplary modification of the first embodiment.

To the contrary, as shown in FIG. 3, when the power transmission gear 30 is arranged on the opposite side (i.e., on the left side in the drawing) of the straight line L to the pressing roller 24, biasing force H2 is applied downward at the time of transmission of the rotational force to cause the separation roller 22 to approach to the fixing roller 21. Thus, the biasing force H2 spoils the biasing force in the arrow showing direction G applied to the separation roller 22 and the tension of the fixing belt 23. Thus, to effectively provide a prescribed tension to the fixing belt 23, the power transmission gear 30 is preferably arranged on the left side in FIG. 2 to distance the separation roller away from the fixing roller 21.

Figure 4:
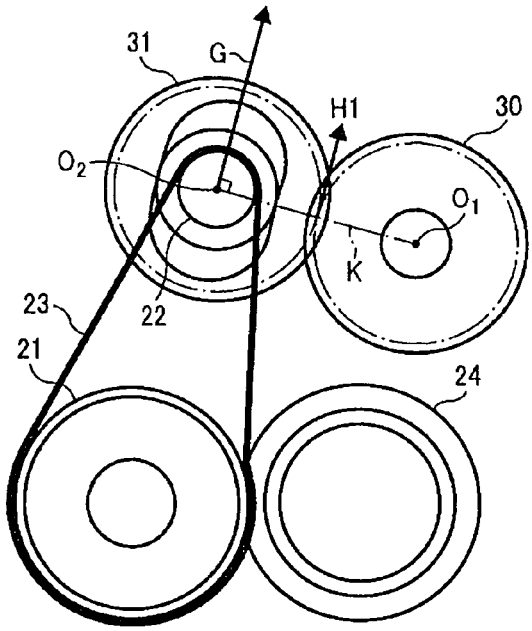
FIG. 4 illustrates an exemplary direction of a biasing force applied to a separation roller according to the first embodiment.

Further, as shown in FIG. 4, the biasing force creating the tension of the fixing belt 23 is preferably applied in a direction (i.e., an arrow G showing direction) perpendicular to a straight line K extending through the rotational centers $O_1$ and $O_2$. As a result, the biasing force H1 and the biasing force of the spring operate in the same direction, and accordingly, the tension is effectively applied to the fixing belt 23.

Now, an exemplary fixing device of a second embodiment is described with reference to FIG. 5. As shown, a first exemplary fixing device 11 includes a fixing roller 21 having a heat source 25, a separation roller 22, an endless fixing belt 23 wound around both of the fixing roller 21 and the separation roller 22, and a pressing roller 24 pressure contacting the fixing roller 21 via the fixing belt 23.

The fixing device 11 of the second embodiment includes a driving force transmitting device for directly transmitting rotational force (from a driving source, not shown) to the separation roller 22. The driving force transmitting device includes a gear train 32 having plural power transmission gears and a supporting member 33. Specifically, the gear train 32 includes first and second gears 34 and 35 meshing with each other; the driving gear 31 is integrally arranged with the separation roller 22.

The driving gear 31 is meshed with the second gear 35 arranged at one end of the gear train 32. Further, a driving force is transmitted from a driving source, not shown, to the driving gear 31 via the first and second gears 34 and 35, so that the driving gear 31 and the separation roller 22 can integrally rotate. Further, the fixing belt 23, the fixing roller 21, and the pressing roller 24 are driven rotated by the separation roller 22.

The supporting member 33 integrally supports the gear train 32 with the driving gear 31 and the separation roller 22. The supporting member 33 is swingable about the rotational center $O_4$ of the first gear 34 arranged at the other end of the gear train 32. Accordingly, a moving route X of the separation roller 22 that moves as the supporting member 33 swings forms a circular arc around the rotational center $O_4$.

Further, the gear train 32 is arranged on the opposite side of the straight line L extending through the rotational centers $O_3$ and $O_2$ of the fixing roller 21 and separation roller 22, respectively, to the pressing roller 24. Thus, when the first gear 34 is rotated in the arrow showing direction in the drawing, a biasing force, not shown, is upwardly applied to an engaging section where the first gear 34 engages with the second one 35. Thus, the biasing force upwardly biases both of the supporting member 33 and the separation roller 22 supported by the supporting member 33. Specifically, the biasing force is applied to cause the separation roller 22 to distance away from the fixing roller 21 and effectively provide the bias to the fixing belt 23.

Figure 6:
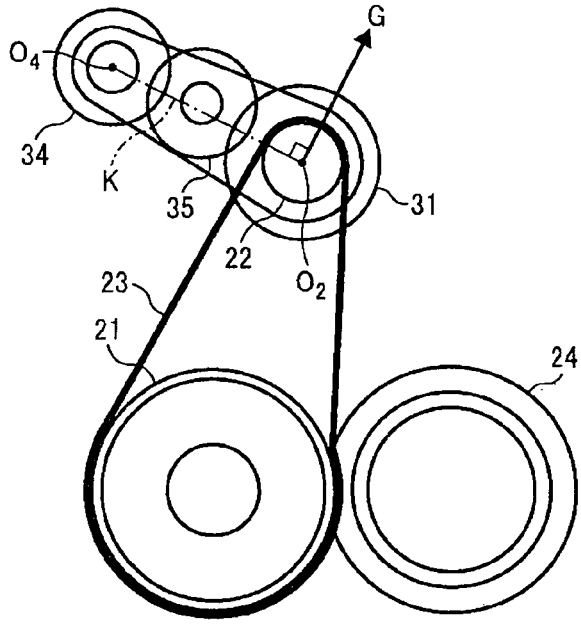
FIG. 6 illustrates an exemplary direction of a biasing force applied to a separation roller according to the second embodiment.
Figure 7:
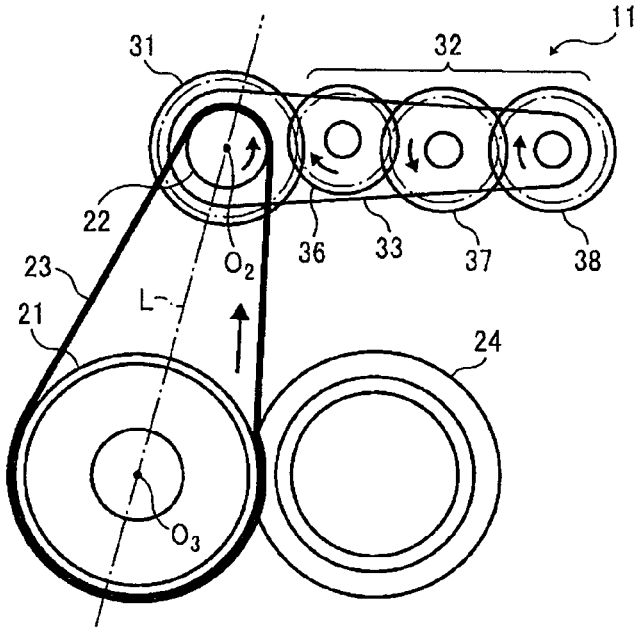
FIG. 7 illustrates an exemplary modification of the second embodiment.

Further, as shown in FIG. 6, the biasing force of the spring for creating the tension of the fixing belt 23 is preferably applied in a direction (i.e., an arrow G showing direction) perpendicular to a straight line K extending through the rotational centers $O_4$ and $O_2$. With such a configuration, the biasing force applied to the separation roller 22 at the time of transmission of the above-mentioned rotational force and the biasing force of the spring for creating the tension of the fixing belt 23 operate in the same direction, and accordingly, the tension is effectively applied to the fixing belt 23.

Number of gears of the gear train 32 can be not less than two. However, arrangement of the gear train 32 becomes different in accordance with the number. For example, either the number is odd or even, the gear train 32 is arranged at a different position. As shown in FIG. 5, when the gear train 32 includes the even number of gears and tension is to effectively be applied to the fixing belt 23, the gear train 32 is arranged on the opposite side (i.e., the left side in the drawing) of the straight line L to the pressing roller 24. To the contrary, when the gear train 32 includes the odd number of gears 36 to 38 and tension is to be effectively applied to the fixing belt 23, the gear train 32 is preferably arranged on the side of the pressing roller 24 (i.e., the right side in the drawing) of the straight line L to the pressing roller 24.

Now, a third exemplary embodiment of a fixing device is described with reference to FIG. 8. Similar to the first and second embodiments, the fixing device 11 includes a fixing roller 21 having a heat source 25, a separation roller 22, an endless fixing belt 23 wound around both of the fixing roller 21 and the separation roller 22, and a pressing roller 24 pressure contacting the fixing roller 21 via the fixing belt 23.

The fixing device 11 of this embodiment includes a driving force transmission use pulley 40, an endless driving force transmission use belt 41, and a supporting member 42 as a driving force transmitting device for directly transmitting rotational force to the separation roller 22. A driving use pulley 43 is integrally arranged with the separation roller 22. The endless driving force transmission use belt 41 is suspended by the driving force transmission use pulley 40 and the driving use pulley 43. Thus, a driving force is transmitted from a driving source, not shown, to the driving use pulley 43 via the driving force transmission use pulley 40 and the driving force transmission use belt 41, so that the driving use pulley 43 and the separation roller 22 can integrally rotate. Further, the fixing belt 23, the fixing roller 21, and the pressing roller 24 are driven rotated by the separation roller 22.

The supporting member 42 integrally supports the driving use pulley 43 and the driving force transmission use pulley 40 with the separation roller 22. The supporting member 42 is swingable about a rotational center $O_5$ of the driving force transmission use pulley 40. Accordingly, a moving route X of the separation roller 22 that moves as the supporting member 42 swings forms a circular arc around the rotational center $O_5$.

The driving force transmission use pulley 40 is arranged on the side of the pressing roller 24 (i.e., on the left side in the drawing) of a straight line L extending through the rotational centers $O_3$ and $O_2$. Thus, when the driving force transmission use pulley 40 is rotated in arrow showing direction in the drawing, biasing force is upwardly applied to the separation roller 22. Specifically, the separation roller 22 distances the biasing force from the fixing roller 21 to effectively create tension thereto.

Figure 9:
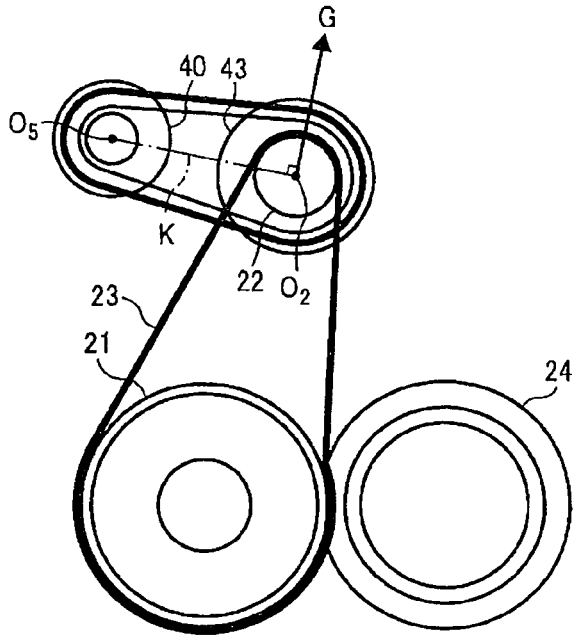
FIG. 9 illustrates an exemplary direction of a biasing force applied to a separation roller according to the third embodiment.

Further, as shown in FIG. 9, a biasing force of the spring or the like creating tension of the fixing belt 23 is preferably applied in a direction (i.e., an arrow G showing direction) perpendicular to a straight line K extending through the rotational centers $O_5$ and $O_2$. With such a configuration, the biasing force applied to the separation roller 22 and the biasing force of the spring operate in the same direction, and accordingly, the tension is effectively applied to the fixing belt 23.

In the above-mentioned various embodiments, the separation roller 22 can be linked with the pressing roller 24 via a one-way clutch. Specifically, the separation roller 22 generally drives the pressing roller 24. However, when slipping occurs between the belt 23 and the pressing roller 24, rotational force is likely not transmitted to the pressing roller 24. Even in such a situation, the one-way clutch conveys rotational force from the separation roller 22 to the pressing roller 24 because of its function. The one-way clutch is not necessarily provided in the separation roller 22, but employed in the other devices as far as it can link a driving source with the pressing roller 24.

Figure 10:
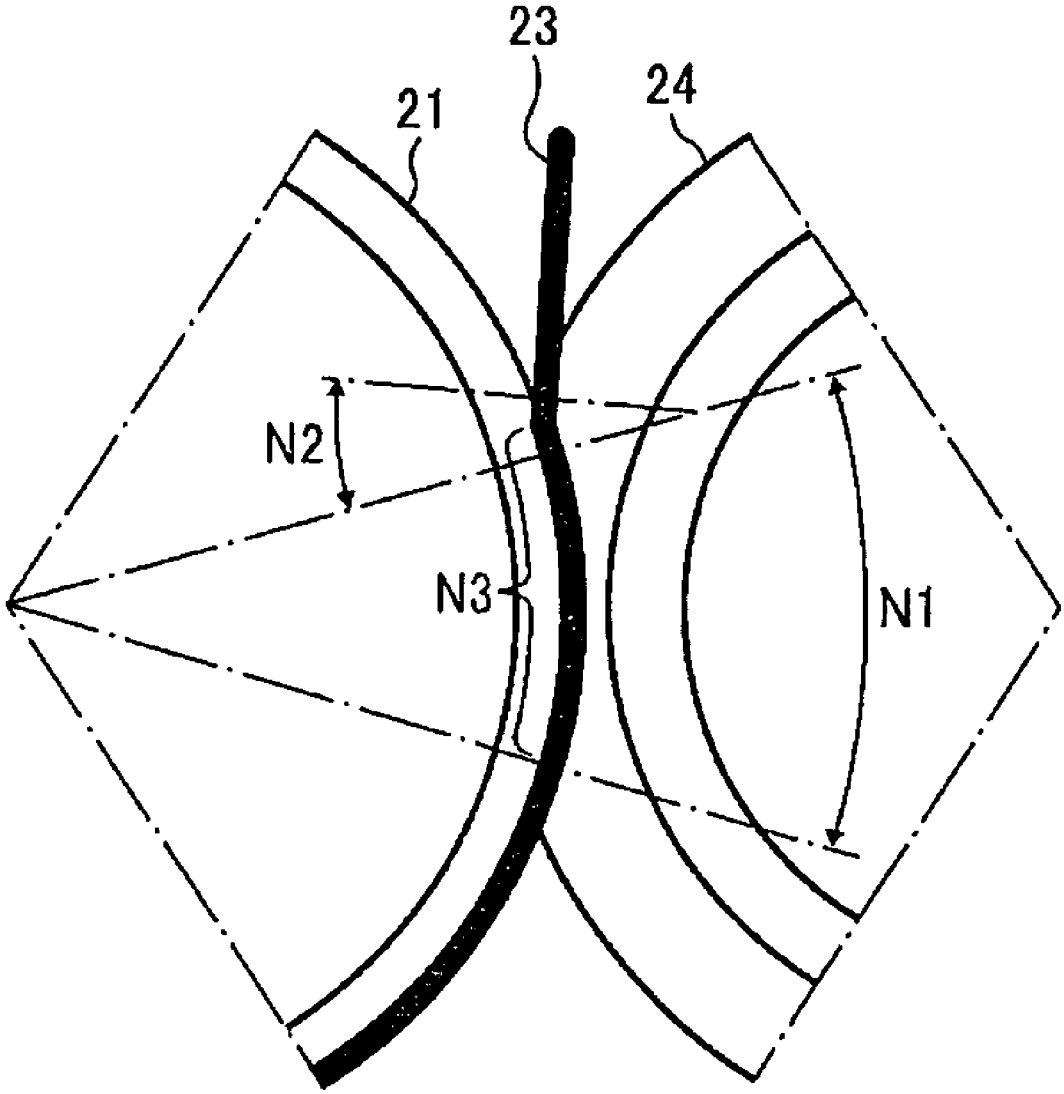
FIG. 10 illustrates an exemplary fixing nip according to one embodiment of the present invention.

Now, an exemplary fixing nip created in the above-mentioned various embodiments is described with reference to FIG. 10. As shown, by depression of the pressing roller 24 onto the fixing roller 21, a fixing nip N1 is formed at a section where the pressing roller 24 contacts the fixing belt 23. Further, a position of a separation roller 22, not shown, is adjusted to cause the fixing belt 23 to approach the pressing roller 24. Thus, at a position where the fixing belt 23 is released from the depression section (i.e., the fixing nip N1) between the pressing and fixing rollers 24 and 21, the fixing belt 23 is caused to contact the pressing roller 24 to create a fixing nip N2. Thus, by arranging and causing the fixing belt 23 to approach the pressing roller 24, a total fixing nip N3 can be larger enough to sufficiently obtain fixing performance. The total fixing nip N3 preferably has a width of from 4 to 8 mm.

Now, an exemplary operation of a fixing device employed in the above-mentioned various embodiments are described. Initially, exemplary operation of the first embodiment is described with reference back to FIG. 2. First, the driving source drives and rotates the separation roller 22 to execute fixing an image. Specifically, the driving source rotates the power transmission gear 30 clockwise, and transmits rotational force of the power transmission us gear 30 to the driving gear 31, so that the driving gear 31 and the separation roller 22 can integrally rotate counter clockwise in the drawing. As the separation roller 22 rotates, the fixing belt 23 travels in the arrow showing direction in the drawing. As the fixing belt 23 travels, the fixing roller 21 and the pressing roller 24 are thereby driven rotated in arrow showing directions in the drawing.

When the fixing device 11 is operated as mentioned above, a sheet P with a toner image T enters the fixing nip N. The sheet P is then heated and pressurized in the fixing nip N, whereby the toner image T is fixed onto the sheet P. Then, the sheet P is conveyed toward the separation roller 22 being tightly contacting the fixing belt 23 running at the time. During conveyance of the sheet P on the fixing belt 23, the toner of the toner image is cooled down and is completely fixed thereonto. Then, the sheet P is separated at a position around the separation roller 22. Thus, the fixing device cools down and fixes the toner onto the fixing belt 23, and after that separates the sheet P at a curvature section of the fixing belt 23 curved by a small diameter separation roller 22. Thus, the sheet P is enabled to be readily separated from the fixing belt after the image fixing process.

Further, since the separation roller 22 functions as a driving roller, the fixing belt 23 travels being extended between the fixing nip N and the separation roller 23 (i.e., a position shown by a reference F in FIG. 2). Thus, slack of the fixing belt 23 can be prevented on the path F, so that an offset of an image or unevenness of brilliance can be suppressed.

Further, the separation roller also serves as a tension roller. Thus, even if the fixing belt expands or shrinks due to heat, the bearing 26 moves along the guide section 28, so that the separation roller 22 either approaches or distances from the fixing roller 21. As a result, a prescribed tension can be continuously applied to the fixing belt 23. Thus, slack of the fixing belt 23 caused by the heat expansion and shrinkage and an offset of an image or unevenness of brilliance can be suppressed.

Further, since the movement route X has the circular arc regarding the rotational center $O_1$. Specifically, the separation roller 22 moves maintaining the same distance to the rotational center $O_1$, when the fixing belt 23 expands and shrinks by heat or the like and thus the separation roller 22 either approaches or withdraw from the fixing roller 21 along a movement route X. Thus, even though the separation roller 22 either approaches or withdraw from the fixing roller 21, a meshing condition between the power transmission gear 30 and the driving gear 31 can be maintained constant. Thus, the driving source can stably transmits rotational force to the separation roller 22 moving. As a result, uneven rotation of the separation roller 22 can be suppressed during its movement, and the lives of the gears 30 and 31 can be prolonged.

Now, an exemplary operation of the second embodiment is described with reference back to FIG. 5. Similar to the above-mentioned first embodiment, a driving source, not shown, drives and rotates the separation roller 22 to execute fixing an image. Specifically, the driving source rotates the first gear 34 counter clockwise, and transmits rotational force of the first gear 34 to the driving gear 31 via the second gear 35, so that the driving gear 31 and the separation roller 22 can integrally rotate counter clockwise in the drawing. As the separation roller 22 rotates, the fixing belt 23 travels in the arrow showing direction in the drawing. As the fixing belt 23 travels, the fixing roller 21 and the pressing roller 24 are thereby driven rotated in arrow showing directions in the drawing.

Similar to the first embodiment as mentioned above, a sheet P with a toner image T enters the fixing nip N, and is heated and pressurized, whereby the toner image T is fixed onto the sheet P. Then, the sheet P is similarly conveyed toward the separation roller 22 being tightly contacting the fixing belt 23 thereon running at the time. The toner of the toner image is cooled down on the fixing belt 23 and is completely fixed thereonto. Then, the sheet P on the fixing belt 23 is separated for a first time due to the curvature formed around the separation roller 22.

Figure 5:
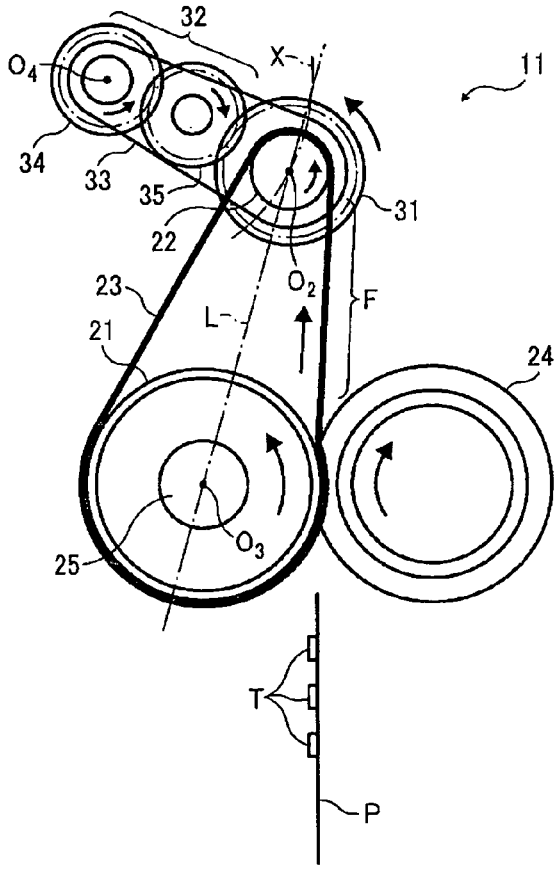
FIG. 5 illustrates an exemplary fixing device according to second embodiment of the present invention.

Since the separation roller 22 functions as a driving roller also in this embodiment, the fixing belt 23 travels being extended between the fixing nip N and the separation roller 23 (i.e., a path shown by the reference F in FIG. 5). Thus, slack of the fixing belt 23 can be prevented on the path F, so that an offset of an image or unevenness of brilliance can be suppressed at same time.

The separation roller 22 also serves as a tension roller also in this embodiment. Thus, even if the fixing belt expands or shrinks due to heat, a prescribed tension can be continuously applied to the fixing belt 23, because the supporting member 33 moves in a prescribed direction, and accordingly, the separation roller 22 either approaches or distances from the fixing roller 21. Thus, slack of the fixing belt 23 generally caused by the heat expansion and shrinkage and an offset of an image or unevenness of brilliance can be suppressed.

Further, since the gear train 32 integrally supported with the driving gear 31 and the separation roller 22 by the supporting member 33, the separation roller 22 can either approach or withdraw from the fixing roller 21, while stably maintaining the meshing condition between the gear train 33 and the driving gear 31. Thus, the driving source can stably transmits rotational force to the moving separation roller 22.

As a result, uneven rotation of the separation roller 22 can be suppressed.

Now, exemplary operation of the third embodiment is described with reference back to FIG. 8. Similar to the above, a driving source, not shown, drives and rotates the separation roller 22 to execute fixing in the fixing device 11. Specifically, the driving source drives and rotates the power transmission use pulley 40 to rotate counter clockwise in the drawing. As the power transmission use pulley 40 rotates, the power transmission use belt 41 travels in the arrow showing direction in the drawing. As the power transmission use belt 41 travels, the driving use pulley 43 and the separation roller 22 are integrally driven rotated counter clockwise in the drawing. Then, as the separation roller 22 rotates, the fixing belt 23 travels in the arrow showing direction in the drawing. As the fixing belt 23 travels, the fixing roller 21 and the pressing roller 24 are driven rotated in arrow showing directions in the drawing.

Also in this embodiment, a sheet P with a toner image T enters the fixing nip N, and is heated and pressurized, whereby the toner image T is fixed onto the sheet P. The sheet P is similarly conveyed toward the separation roller 22 being tightly contacting the fixing belt 23 running at the time. The toner of the toner image is cooled down on the fixing belt 23 and is completely fixed. Then, the sheet P is separated for the first time due to the curvature formed by the separation roller 22. Thus, offset of an image or unevenness of brilliance can be suppressed.

Figure 8:
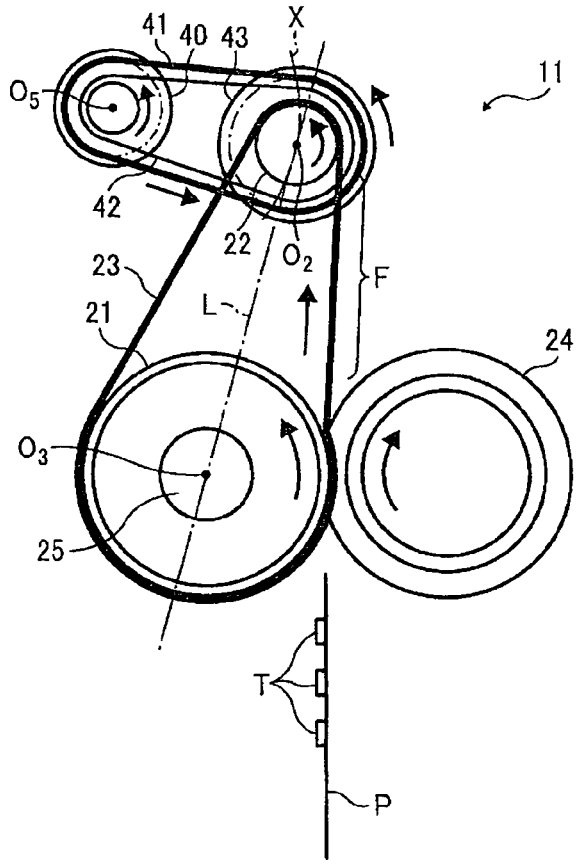
FIG. 8 illustrates an exemplary fixing device according to third embodiment of the present invention.

Further, since the separation roller 22 also functions as a driving roller in this embodiment, the fixing belt 23 travels being extended between the fixing nip N and the separation roller 23 (i.e., on a path shown by the reference F in FIG. 8). Thus, slack of the fixing belt 23 can be prevented on the path F, so that an offset of an image or unevenness of brilliance can be suppressed at same time.

Further, the separation roller also serves as a tension roller in this embodiment. Thus, even if the fixing belt expands or shrinks due to heat, a prescribed tension can be continuously applied to the fixing belt 23, because the supporting member 42 moves in a prescribed direction, and accordingly the separation roller 22 either approaches or distances from the fixing roller 21. Thus, slack of the fixing belt 23 caused by the heat expansion and shrinkage and an offset of an image or unevenness of brilliance can be suppressed.

Further, since the power transmission use pulley 40, the driving use pulley 43, and the separation roller 22 are integrally supported by the supporting member 42, the separation roller 22 can either approach or withdraw from the fixing roller 21, while maintaining the prescribed tension of the power transmission use pulley 41. Thus, the driving source can stably transmit rotational force to the separation roller 22 moving. As a result, uneven rotation of the separation roller 22 can be suppressed.

Also in this embodiment, the separation roller 22 provides the above-mentioned both of functions and achieves the same results.

Further, the moving route X of the separation roller 22 is the same circular arc as mentioned above and achieves the same results.

Figure 11:
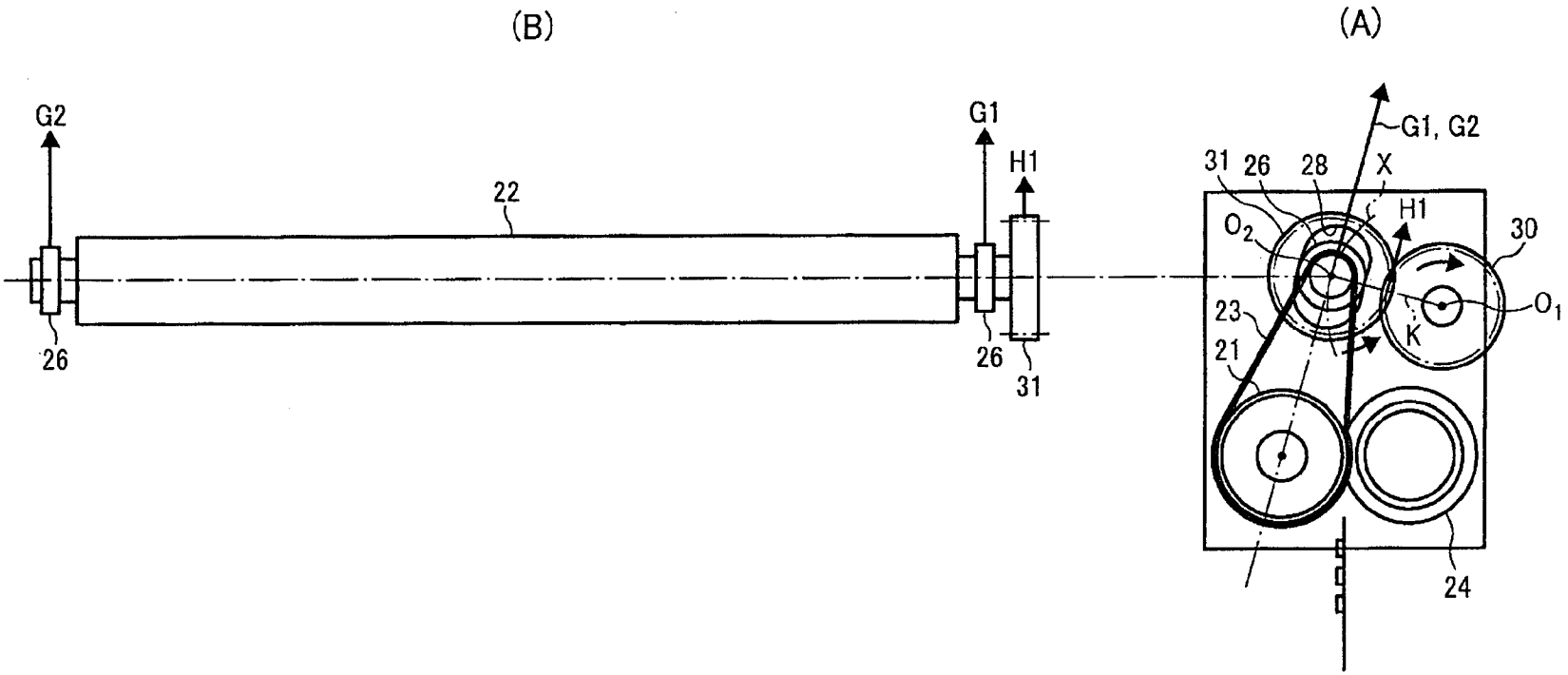
FIG. 11A illustrates an exemplary configuration of the fixing device of FIG. 2.
FIG. 11B illustrates an exemplary separation roller included in the fixing device of FIG. 11A.

Now, an exemplary belt tension adjustment mechanism is described with reference to FIGS. 11A, 11B, and FIG. 2.

As shown in FIG. 11B, the separation roller 22 receives coil spring forces G1 and G2 at its both ends from extension coil springs, not shown, so that a tension of the fixing belt 23 is created. Further, as shown in FIG. 11A, the spring forces G1 and G2 are applied in the same direction perpendicular to the straight line K that extends between the rotational centers $O_1$ and $O_2$. However, the spring forces G1 and G2 are not always directed perpendicular to the straight line K.

Figure 12:
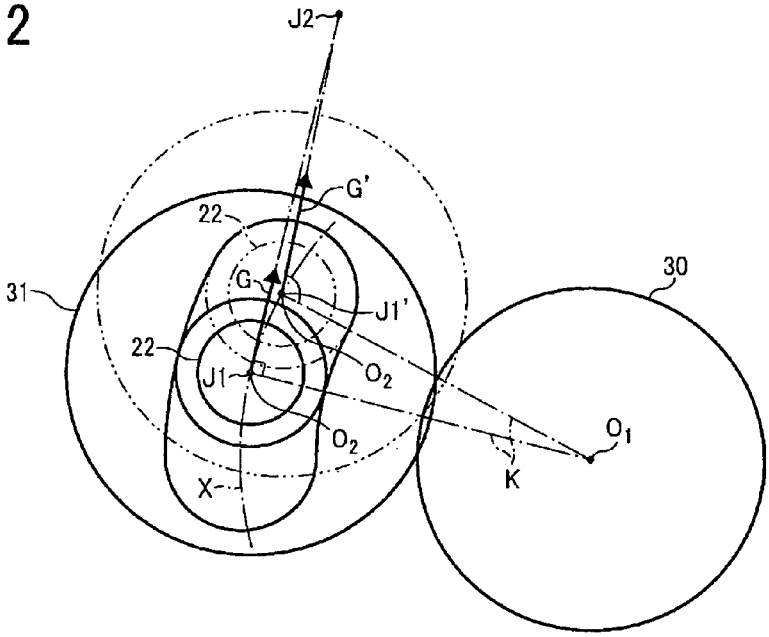
FIG. 12 illustrates an exemplary change of the biasing force as a separation roller moves according to one embodiment of the present invention.

For example, as shown in FIG. 12, a spring force G is directed perpendicular to the straight line K in an initial stage, when a reference J1 represents a position of one end of the spring attached to a separation roller 22, a reference J2 represents a position of the other end of the spring attached to a frame or the like of the fixing device. When the separation roller 22 upwardly moves along the circular arc moving route X, and the one end of the coil spring also moves from the position J1 to J1', a biasing force G' generated after movement of the separation roller 22 becomes not directed perpendicular to the straight line K any more. Specifically, the direction of the force of the spring is not always the same to that of a tangent line of the moving route X.

Figure 13:
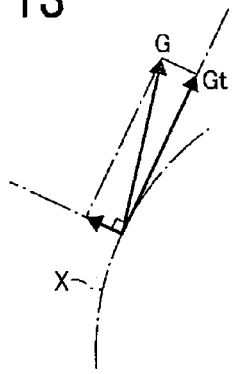
FIG. 13 schematically illustrates an exemplary tangent line direction component of the biasing force.

Further, when the separation roller 22 is located at an optional position on the moving route X, a component Gt of the biasing force G in the tangential direction (hereinafter referred to as tangential direction component force) provides a tension as shown in FIG. 13.

Further, when the power transmission gear 30 is rotated and the rotational force thereof is transmitted to the driving gear 31, the biasing force H1 is generated at the engaging section where the power transmission gear 30 engages with the driving gear 31 as mentioned above with reference to FIG. 11. Since the biasing force H1 is directed along the tangent line of the moving route X and distance the separation roller 22 from the fixing roller 21, the H1 serves as the tension.

However, as shown in FIG. 11B, the biasing force H1 is applied to the right side end of the separation roller 22 via the driving gear 31. Thus, when references G1*t* and G2*t* represent the tangent line direction component forces of the spring forces G1 and G2, respectively, applied to the right side end is the sum of the tangent line direction component force G1*t* and the biasing force H1. Whereas the tension applied to the left side only includes the tangent line direction component force G2*t*.

Thus, the biasing forces (i.e., the tensions) are not the same at both ends of the separation roller 22.

As a result, the separation roller 22 cannot be held in parallel to the fixing roller 21 or the like, and the fixing belt deviates to one side of the separation roller 22 and likely deteriorates its running performance. In general, there is provided a deviation prevention mechanism for preventing deviation of a fixing belt in the fixing device, and thus the deviation can be suppressed by a certain degree. However, when a difference of the biasing force between both side ends of the separation roller exceeds a prescribed level, the deviation prevention mechanism cannot prevent such a level, and the fixing belt is damaged in the worst case.

As a countermeasure against such deviation of the fixing belt, two driving sources can be arranged at both side ends of the separation roller to transmit the rotational forces, respectively. Specifically, since the biasing forces caused during the time of rotation driving are applied to the both side ends of the separation roller, respectively, unevenness of the tensions can be suppressed. However, number of parts undesirably increases in views of saving cost and downsizing.

Figure 14:
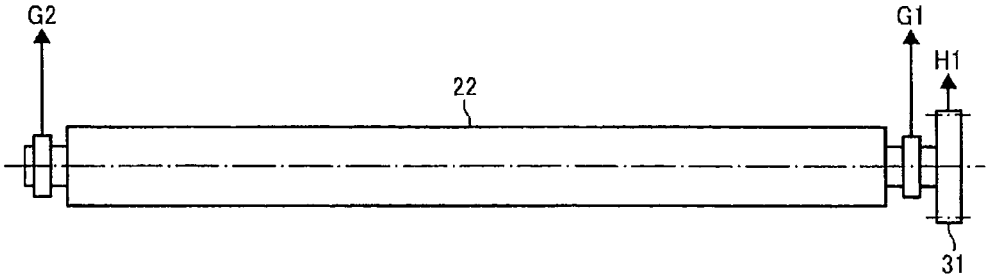
FIG. 14 illustrates an exemplary tension adjustment mechanism according to one embodiment of the present invention.

Then, as another countermeasure, a spring biasing force applied to each of the both side ends of the separation roller is adjusted as shown in FIG. 14. Specifically, as shown, the biasing force G1 of the spring arranged on the right side end, to which rotational force of the separation roller 22 is transmitted, is adjusted smaller than that of G2 of the spring arranged on the left side end thereof. More specifically, component forces G1*t* and G2*t*, not shown, in the tangent line direction, are adjusted to meet the following relation all the time when the separation roller moves along the moving route, wherein G1 and G2 represent components of the spring biasing forces in the tangent line direction:

$$G1t<Gt2.$$

Thus, uneven tension can be suppressed at the both side ends of the separation roller. Since the above-mentioned driving sources can be omitted, the fixing device can save cost and is downsized.

Further, when the component force G1*t* applied to the rotational force transmission side of the separation roller 22 in the tangent line direction is decreased by an amount of the biasing force H1 added when rotational force is transmitted, the tensions caused at both side ends of the separation roller can be equalized as calculated below, so that more stable traveling performance can be obtained:

$$G1t+H1=G2t.$$

To decrease the spring force G1 applied to the rotational force transmission side of the separation roller 22 than that of G2 applied to the opposite side thereof, different type springs from each other can be used at the both side ends, respectively. However, it is not economically beneficial. To differentiate biasing forces at both side ends, the same type springs having a different elastic deformation amount (for example, an extension or compression length) are provided. For example, when the extension spring is used, the extension amount of the spring arranged on the rotation transmission side is smaller than that on the opposite side. Whereas, when the compression spring is used, the compression amount of the spring arranged on the rotation transmission side is smaller than that on the opposite side.

Figure 15:
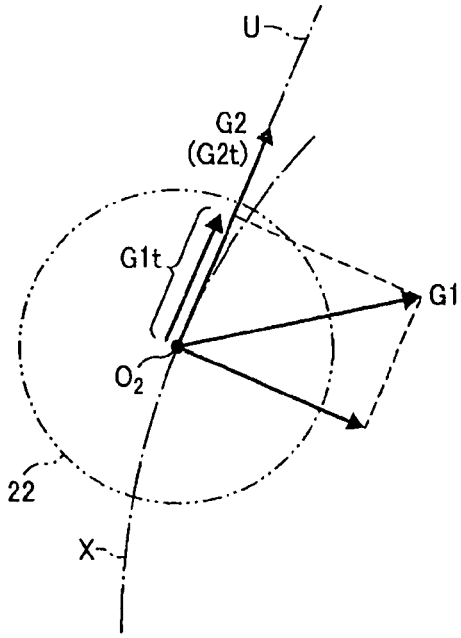
FIG. 15 illustrates exemplary components of the biasing force applied in a tangent line direction when a direction of the biasing force is changed.

When the same type springs are attached to both side ends but a biasing direction thereof is differentiated from each other, component forces in the tangent line direction acting as a tension can be differentiated from each other. For example, even when the spring force G1 applied to the rotational force transmission side is as same as that of G2 applied to the opposite side thereof, only the tangent line direction component forces G1*t* and G2*t* of the biasing forces G1 and G2 provide tensions. Accordingly, as shown in FIG. 15, by increasingly inclining a vector of the biasing force G1 applied to the rotational force transmission side in relation to the tangent line U of the moving route X than that of G2, the component forces G1*t* in the tangent line direction applied to the rotational force transmission side can be smaller than that of G2*t* applied to the opposite side. Then, directions of the spring forces G1 and G2 are preferably determined to meet the following relation over the entire moving route X:

$$G1t<Gt2.$$

Further, if the component force G1*t* applied to the rotational force transmission side in the tangent line direction is decreased by an amount of the biasing force H1 caused when rotational force is transmitted by adjusting directions of the biasing forces G1 and G2, tensions caused at both side ends of the separation roller can be equalized, so that more stable traveling performance can be obtained.

The above-mentioned tension adjustment mechanism can be employed in the embodiment described with reference to FIGS. 5 to 9 beside that of FIG. 2. Another biasing force providing device can also be employed instead of the spring.

ADVANTAGE

According to one embodiment of the present invention, since the separation roller serves as a driving roller and a tension roller, slack of a fixing belt can be suppressed, and offset of an image and uneven brilliance can be suppressed.

Obviously, numerous additional modifications and variations of the present invention are possible in light of the above teachings. It is therefore to be understood that within the scope of the appended claims, the present invention may be practiced otherwise than as specifically described herein.

What is claimed is:

1. A fixing device comprising:

a fixing roller configured to fix a non-fixed toner image onto a sheet;

a separation roller arranged downstream of the fixing roller and configured to separate the sheet, said separation roller being configured to approach or to withdraw from the fixing roller;

an endless fixing belt wound around the fixing roller and the separation roller;

a pressing roller pressing against the fixing roller via the fixing belt and configured to cooperatively fix the non-fixed toner image with the fixing roller;

a guiding member secured to the fixing device and having a guiding hole, said guiding member being configured to guide the separation roller when the separation roller approaches or withdraw from the fixing roller along the guiding hole;

at least one belt tensioner configured to create a prescribed tension on the fixing belt by applying a tension biasing force to the separation roller in an opposite direction to the fixing roller; and a driving force transmitting device configured to directly transmit rotational driving force to the separation roller via an engaging section of the separation roller, wherein said guiding hole has an arc shape coaxial with the driving force transmitting device.

2. The fixing device as claimed in claim 1, wherein a biasing force applied to the engaging section from the driving force transmitting device is directed to a prescribed direction causing the separation roller to be distanced from the fixing roller.

3. The fixing device as claimed in claim 1, further comprising:

a bearing attached to a rotary shaft of the separation roller;

a driving gear integrally mounted on the rotary shaft; and a power transmission gear integrally mounted on a rotary shaft of the driving force transmitting device, said power transmission gear meshing with the driving gear, wherein said guide member guides the bearing.

4. The fixing device as claimed in claim 3, wherein said power transmission gear is arranged on the pressing roller side of a straight line extending through rotational centers of the fixing roller and the separation roller.

5. The fixing device as claimed in claim 1, further comprising:

a driving gear integrally mounted on the separation roller, a gear train included in the driving force transmitting device, said gear train having at least two power transmission gears linked with each other and configured to engage with the driving gear at one end; and a supporting member configured to integrally support the gear train, the driving gear, and the separation roller, wherein said supporting member swings around a rotational center of one of the at least two power transmission gears arranged on the other end of the gear train.

6. The fixing device as claimed in claim 5, wherein the gear train is arranged on the pressing roller side of a straight line extending through rotational centers of the fixing roller and the separation roller when there is an odd number of power transmission gears, and on the opposite side of the straight line to the pressing roller when there is an even number of power transmission gears.

7. The fixing device as claimed in claim 1, further comprising:

a driving use pulley integrally mounted on the separation roller, a power transmission use pulley mounted on the driving force transmitting device;

a power transmission use endless belt wound around the driving use pulley and the power transmission use pulley; and a supporting member configured to integrally support the power transmission use pulley, the driving use pulley, and the separation roller, wherein said supporting member swings around a rotational center of the power transmission use pulley.

8. The fixing device as claimed in claim 7, wherein the power transmission use pulley is arranged on the opposite side of a straight line extending through rotational centers of the fixing roller and the separation roller to the pressing roller.

9. The fixing device as claimed in claim 1, wherein said at least one tensioner includes a pair of tension application devices attached to both ends of the separation roller, respectively, wherein the driving force transmitting device transmits the rotational drive force to one end of the separation roller and generates a prescribed biasing force at the engagement section, said prescribed biasing force being directed opposite to the fixing roller to cause the separation roller to be distanced from the fixing roller, wherein a component of the tension use biasing force applied to one end of the separation roller is smaller than that applied to the other end during the movement of the separation roller along the guiding member, said component being disposed parallel to a tangent line of the arc shape, and wherein said one end receives the rotational driving force from the driving force transmitting device.

10. The fixing device as claimed in claim 9, wherein said pair of tension application devices includes the same type of elastic members, and wherein the component of the one end is made smaller than that of the other end by differentiating an elastic deformation amount from the other.

11. The fixing device as claimed in claim 9, wherein said pair of tension application devices include the same type of elastic members, and wherein the component of the one end is made smaller than that of the other end by differentiating a direction of biasing force of the tension application device from the other.

12. An image forming apparatus including the fixing device as claimed in claim 11.

* * * * *